US005846143A

United States Patent [19]

Brock et al.

[11] Patent Number: 5,846,143

[45] Date of Patent: Dec. 8, 1998

[54] GOLFING AID

[75] Inventors: Alan James Brock; Mary Grace Brock, both of Adelaide, Australia

[73] Assignee: Golf Inventions Pty Ltd., West Lakes, Australia

[21] Appl. No.: 849,579

[22] PCT Filed: Jan. 24, 1996

[86] PCT No.: PCT/AU96/00030

§ 371 Date: Jun. 3, 1997

§ 102(e) Date: Jun. 3, 1997

[87] PCT Pub. No.: WO96/23552

PCT Pub. Date: Aug. 8, 1996

[30] Foreign Application Priority Data

Jan. 31, 1995 [AU] Australia ..... PN0807

[51] Int. Cl.[6] ..... A63B 69/36

[52] U.S. Cl. ..... 473/409; 473/227

[58] Field of Search ..... 473/227, 409

[56] References Cited

U.S. PATENT DOCUMENTS

| | | | |
|---|---|---|---|
| 3,858,881 | 1/1975 | Hurwitz . | |
| 3,918,721 | 11/1975 | Trask, Jr. . | |
| 3,954,271 | 5/1976 | Tredway, Sr. . | |
| 4,023,812 | 5/1977 | Lorang . | |
| 4,145,054 | 3/1979 | Stewart | 473/227 |
| 4,170,356 | 10/1979 | Banks | 473/227 |
| 5,009,426 | 4/1991 | Cox | 473/227 |
| 5,174,575 | 12/1992 | Leith et al. . | |

FOREIGN PATENT DOCUMENTS

WO 88/03042 5/1988 European Pat. Off. .

*Primary Examiner*—George J. Marlo

*Attorney, Agent, or Firm*—Merchant, Gould, Smith, Edell, Welter & Schmidt, P.A.

[57] ABSTRACT

A method of training golf swing including the steps of adjusting the position of a guide relative to a golf club so that the guide projects vertically when the club is held in an address position, a tip at a free end of the guide bears against the radius side of a leading forearm when the club is held in a back swing position, and the tip bears against the radius side of the leading forearm when the club is held in a follow through position. Repeatedly swinging the golf club between back swing and follow through positions. Correcting golf swing to ensure that at the back swing position the tip bears against the radius side of the leading forearm. Correcting golf swing to ensure that at the follow through position the tip bears against the radius side of the leading forearm. By use of the method the golf swing is trained to be within a plane and errors such as wrist cocking are detected and can be corrected. Further, the technique of radial deviation of the wrists to provide an improved swing can also be trained. In a preferred form the guide has an arcuate tip that bears against and contours the leading forearm. Being arcuate the tip of this form provides more positive registering of correct swing.

11 Claims, 3 Drawing Sheets

GOLFING AID

BACKGROUND OF THE INVENTION

This invention relates to a golfing aid for improving the capacity of a player to correctly execute the swing of a golf club.

A golf club during a swing should be maintained to move through an arc, starting at the address position (bottom of the stroke) and moving upwards during the backstroke to its top position and then downwards during the downswing to strike the golf ball and again upwards during the follow-through. This swing should be carried out with the club held firmly in the two hands of the player, with the player leaning forward and swinging his body during the major portion of the stroke to cause the head of the club to follow the correct arc. During this process the leading arm generally plays the role of acting as the guide for the path of the club so that the swing of the leading arm directs the path of the club, whereas the lagging arm plays a lesser role in maintaining the path of the golf club and a greater role in propelling the club.

During the swinging motion the club is turned about the axis of its shaft in one direction on the upward movement and in the reverse direction on the downward movement and it will thus be realised that it is highly important to be able to control not only the swing of the club in the arc, but also its rotation about the shaft axis as it moves through the arc in both the upward and downward swing. At the time that the head strikes the ball, the club must be accurately positioned to propel the ball in the required direction.

It has been long recognised that the swing of the golf club is one of the critical factors of a consistent performance, and a great deal of experimentation has taken place to analyse the faults of individual players and to provide an aid to assist in the improvement of a golf swing. A great number of devices have been constructed ranging from complex and large structures including robotic arms to assist in guiding the swing of the player, or hoops to guide the head of the golf club in the correct arc. Each of these methods and apparatuses are directed at certain aspects of the swing and assist to varying degrees in improving the swing.

Many of the larger, complex devices suffer the fault of inconvenience of use, a large requirement of storage space and also expense, and are usually unaffordable to the majority of golf players because of the high cost.

A number of smaller devices have also been suggested each focussing on specific aspects of the position of the golf club relative to the body of the player. The present invention is one of several that is related to a guide member that attaches to or is made as part of the shaft of a golf club and which gives an indication of the quality of the swing by its position relative to a body part of the user.

A number of suggestions have been made that have a guide member extending from the stem of a golf club or practice club at an angle to avoid contact with the limbs of the user when the club is swung. U.S. Pat. No. 4,682,775 by Wood has the guide member positioned to correct a slice swing. The guide member extends downwardly so that if the club shaft is not rotated in a counter clockwise direction to the desired position, the guide member will contact the rear leg of the user. U.S. Pat. No. 4,145,054 by Stewart is somewhat similar to the concept in U.S. Pat. No. 4,682,775 except that the guide member is intended to pass between the forearms of the user, should the swing be faulty then contact will be made with one or other of the forearms of the user. U.S. Pat. No. 3,918,721 by Tradsk uses a flexible guide member, which is attached to the golf club the end position of the flexible guide member can be placed in a variety of positions. The majority of the uses are related to non-contact positions of the wrist and/or forearm.

There are also a number of documents that make suggestions of apparatuses where the guide member makes contact with part of the body of the user. U.S. Pat. No. 2,462,955 by Glancy has a member which clamps onto the stem of a golf practice stick or golf club, the end of the member rests on the shoulder of the lagging arm when in its top position and is removed when the downswing commences. Australian Patent specification 618518 in the name of Cox is similar to the Wood device except that the guide is in the form of an arcuate guide member, which maintains contact with the wrist of the lagging arm throughout the stroke so that a break in contact or increased pressure indicates a fault. U.S. Pat. No. 5,009,426 the name of Cox is a further development of the above Australian patent where a stop is connected with the arcuate guide member which stop is to contact the forearm of the lagging arm so that the angle of the forearm of the lagging arm relative to the shaft of the golf-club is defined at the commencement of the downswing.

U.S. Pat. No. 4,023,812 in the name of Lorang is the closest known prior art to the present invention. This document suggests a guide member which has a spring loaded "clicker" device. The free end of the guide member starts off in contact with the lagging forearm of the user, thus when the user brings the club up on the back swing, contact of the guide member on the forearm actuates the clicker so that the player hears the "click" which indicates that the club is correctly positioned. On the downswing the clicker will again click to indicate that contact with the lagging forearm has broken. At the end of the follow through contact is again made with the lagging arm to show that the correct position has been assumed. The use of this device is said to teach the "piggy back" of the cocking of the wrist together with the arm swing to increase the speed with which the club strikes the ball.

All the above prior art concentrates on aspects of the golf swing which centre on the position of the golf club relative to body parts such as the shoulder, relative to both forearms to pass therebetween, and most specifically with the lagging arm. The present invention however has found that by focussing on the leading arm far greater improvements can be achieved, and in particular facilitates with tactile feedback that the leading arm and consequently the shaft of the golf club are maintained within a correct plane to execute an improved golf swing.

Of particular detriment to maintaining an optimum swing is a fault that commonly occurs at the beginning of the downward stroke, and again at the end of the stroke which draws the shaft of the golf club out of the virtual plane of the swing. Such a fault is known as wrist cock where instead of maintaining the hand in the plane of the swing the wrists are bent in the direction in which the fingers curl and consequently draws the shaft out of the plane of the swing. Instead of extending the reach by wrist cock it is desirable to extend the reach by radial deviation of the wrist where the wrist is bent in the plane that might best be described as the plane of the palm. Radial deviation is not detrimental to the swing because, at all times, the shaft of the club is within the plane of the swing, whereas with wrist cock the plane of the swing is only entered once the swing has begun, and consequently there is considerably less control and consequently considerably less consistency of swing.

SUMMARY OF THE INVENTION

The object of this invention is to facilitate the correct holding of the club during a stroke.

This is achieved by attaching to the shaft of the club a guide member which projects from the club and has on it a tip which, during part of the stroke, contacts the leading forearm of the golfer provided the golfer has the correct angular grip on the club and is moving his body and arms correctly.

In one form the invention could be said to reside in a guide member for attachment to a golf club, the golf club having a club head and a shaft extending upwardly from the club head to a hand grip, said guide comprising an attachment means to be attached to the shaft of the club on or below the hand grip of the club, a stem of the guide extending away from the shaft and angled upwardly with respect to the shaft, the stem having a tip on its free end for contact with the leading forearm of a player on the radial side during correct use when the club is properly gripped with the leading hand at approximately right angles to the shaft of the club and when the stem extends away from the shaft in the same radial direction as the leading edge of the club head.

It will be understood that instead of providing a guide member which is preferably removable it may be desired to mount a guide member permanently on the shaft of a golf club, or alternatively it may be desired to make a dedicated training club with the guide member permanently positioned in place.

This guide member is normally positioned in the plane of the striking face of the head of the club, and when the club is held in the address position prior to effecting a stroke, the tip of the guide member is positioned clear of the forearm and moves into line with it and during the backstroke as the club reaches the final part of the upward movement should contact the forearm of the user and during the downswing should continue for a time to contact the leading forearm but leaves this contact shortly after beginning the down swing, the downswing is continued, the ball is struck and contact is once again made with the leading forearm toward the end of the follow-through.

The angle of the grip between the leading forearm and the shaft of the club is maintained in the first portion of the downswing and the last portion of the follow through. This is found to have a number of advantages. The tip of the guide bears against the radial part of the forearm in the backswing and has a tendency to cause the wrist of a player to deviate radially, at that point, thereby assisting with piggy backing of the radial deviation of the leading wrist to impart extra swing. Any wrist cocking is very easily noticed because contact with the tip will be uncomfortable or the tip will loose contact with the forearm, because wrist cocking causes the shaft to move out of the arc of the swing.

Maintaining the contact of the forearm in the initial stages of the downswing also assists with maintaining a fuller arc during the initial parts of the swing in so far as the player is conscious of the position of the leading arm, moreover the collect angle between the club and the leading arm is maintained, and this encourages the downswing to extend further "backwards" of the player when there is contact. Greater power can be achieved at impact by maintaining the radial deviation of the wrist on the start of the downswing.

A more comfortable contact is also made with the leading forearm towards the end of the follow through if the arc of the swing is fuller. Contact of the tip with the leading forearm in the follow-through is a very sensitive measure of the trueness of the arc of the swing, any slight deviation will immediately be sensed by the tip contacting to one side of the radial part of the leading forearm or by reason of the tip missing the leading forearm altogether. This is assisted also by the shape of the tip having a contact contour that rests comfortably on the radial side of the forearm of the player. The contact contour is preferably arcuate, and includes two arms protruding away from the stem of the guide member within which the forearm registers loosely if it is correctly positioned.

Thus the device is so arranged that the correct attitude of the shaft, which has an optimum geometry relative to the player's body during the upswing and down swing of the club is correctly maintained.

The invention may also be said to reside in a method of positive feedback to enhance the use of radial deviation in a golf swing and to minimise wrist cocking, the method comprises, attaching a guide member to the stem of a golf club, the golf club having a club head and a shaft extending upwardly from the shaft to a hand grip, said guide comprising an attachment means to be attached to the shaft of the club on or below the hand grip, a stem of the guide extending away from the shaft and angled upwardly away from the shaft, so that the stem extends radially away from the shaft of the club in the same direction as the leading edge of the club head, the stem having a tip on its free end, the stem of the guide so formed that when put into a position below the position of a player's hands holding the shaft, the tip contacts the radial side of the leading forearm of the player when held in its normal position at right angles to the shaft of the club, and that no contact is made with either forearm when the club is held in the address position or when striking the ball, the method including attaching the attachment means to the shaft of the golf club, so that the stem extends away from the shaft in the same radial direction as the club head, executing the swing including the steps of; assuming the address position, with the guide stem extend vertically upwardly away from the shaft, raising the arm to a top of a backswing position, and contacting the leading forearm with said tip, swinging the club in a downswing and losing contact with the forearm shortly after the downswing has commenced, making contact again at an upper part of the follow through with the leading forearm of the player.

The constructional details of the invention can be varied but according to a convenient form the guide member comprises a clamp which can be rigidly attached to the shaft of the club adjacent to the grip and projects outwardly and angularly therefrom to position the tip at the right distance from the handle or grip so that during the swing the tip of the guide member will lightly rest on the forearm of the player.

The guide member can be made telescopic to allow for personal adjustment and can be moveable along the shaft to select a convenient position and also can be adjustable to bring the tip toward or away from the grip of the shaft of the club.

It would of course be possible to make such a device a permanent part of a practice club if that is desirable.

DESCRIPTION OF THE DRAWINGS

For a better understanding the invention will now be described with reference to two embodiments of the invention as shown in the accompanying illustrations the first embodiment being shown in FIGS. 1 to 9 and the second embodiment being shown in FIG. 10. In the illustrations.

DETAILED DESCRIPTION OF THE ILLUSTRATED EMBODIMENTS

Figure 1:
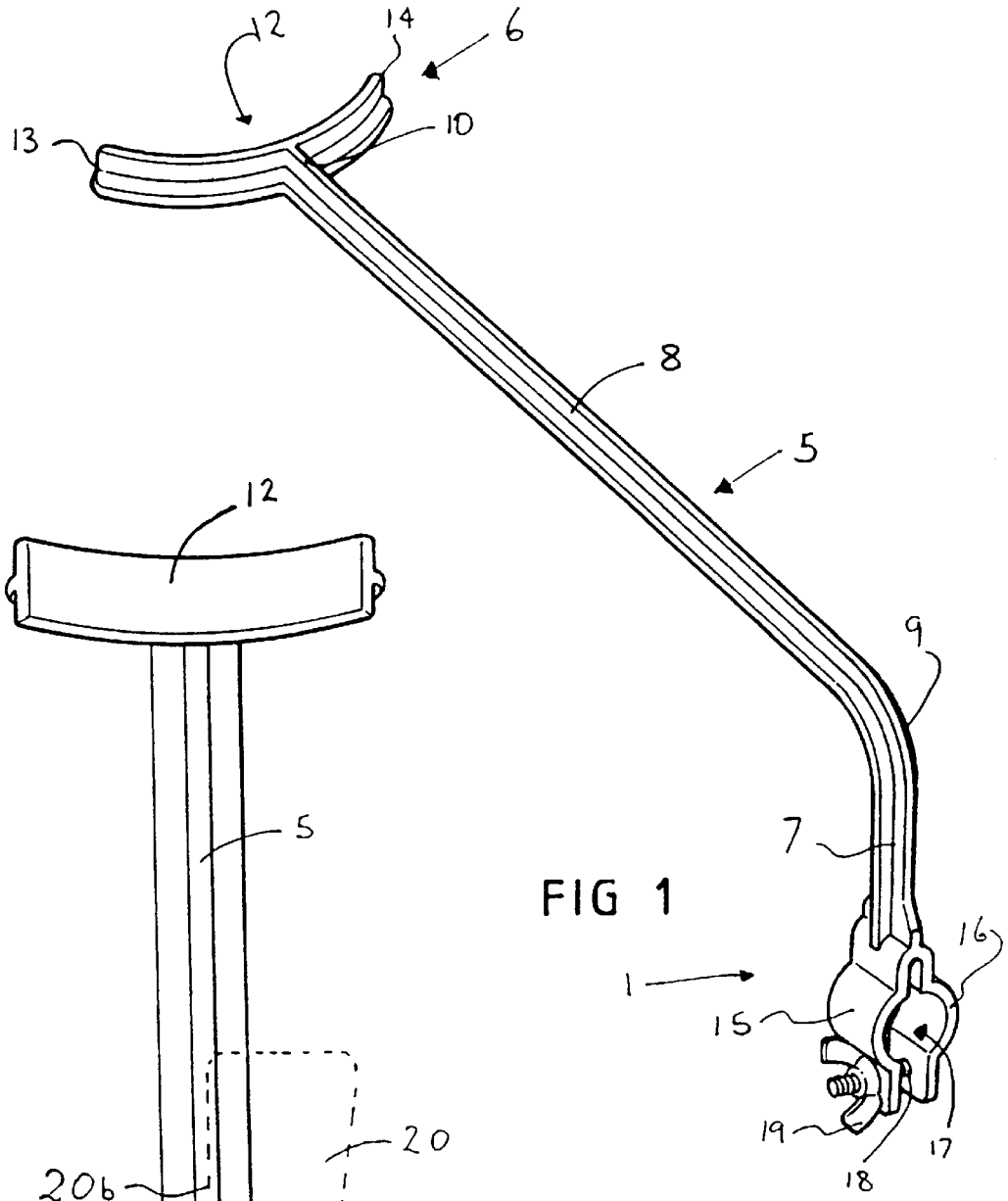
FIG. 1 is a perspective drawing of the first embodiment of the guide member and shows details of the means by which attachment is effected to a golf club, the stem extending away from the club, and an arcuately shaped tip.

Similar reference characters indicate corresponding parts throughout the several views of the drawings.

Dimensions of certain of the parts as shown in the drawings may have been modified and/or exaggerated for the purposes of clarity of illustration.

A perspective view of a first embodiment of the invention is shown in FIG. 1. The guide member comprises an attachment means (1) to be attached to the shaft (2) of a golf club (3) on or below the hand grip (4) of the golf club. A stem (5) of the guide extends away from the shaft (2) and is angled upwardly away from the shaft. The stem has a tip (6) on its free end for contact with the leading forearm (21) of the player.

The stem (5) of the guide comprises a first portion (7) extending away laterally from the shaft of the golf club so as to be kept clear of the hands of the user, a second portion (8) extends upwardly with respect to the shaft, but it still extends away from the shaft but at a smaller acute angle from the shaft as compared to the angle of the first portion. A curved portion (9) of the shaft lies between the first portion (7) and the second portion (8). The second portion (8) of the stem extends upwardly with respect to the shaft and is also angled away from the shaft and at an free end (10) has the tip (6).

The tip includes a contact surface (12) which is contoured to rest on the radial side of the forearm of the player. In this illustrated embodiment the contour is arcuate with a radius that will accommodate the radial side of the forearm of a player. Arms (13, 14) of the arcuate tip curve around the forearm to loosely register on the radial side of the forearm when positioned correctly. This will provide for comfortable contact only when accurately positioned on the radial side of the forearm.

The attachment means (1) is removable and can therefore be attached to the shaft of a variety of different clubs. The attachment means seen best in FIG. 1 and 2 comprises a clamp, including two clamp wings (15, 16) extending from the first portion (7) of the stem, forming between the wings in a central portion of the clamp a channel (17) to accommodate the shaft (2) of the golf club. The wings extend to a securing part where a hole is formed through each respective one of the wings, which holes are aligned for passage therethrough of a securing bolt (18). The two wings of the clamp can be secured to the shaft of a club by tightening wing nut (19) on the securing bolt to urge the two clamp wings together over the shaft.

The guide member, apart from the securing bolt and the wing nut, is integrally formed of a rigid plastics. The plastics can be any one of a variety plastics that is sufficiently rigid to stay in place so that the position of the tip (12) is fixed relative to the shaft of the golf club when secured to it, but also sufficiently flexible to allow for the wings of the clamp to be separated so the clamp can be fitted over the shaft of a golf club. One material that might be used is polypropylene.

It can be seen that the stem (5) of the guide member is generally cruciform in cross section, this cross section maintains resistance of the stem to flexure in any direction. The clamp wings however are flattened in order that the wings can flex apart so as to fit over a shaft before tightening the wing nut. It can also be seen that the tip is T shaped in cross section, to promote rigidity of the tip, and it will be appreciated that the arcuate shape will add to the structural stability of the tip. The contact surface (12) of the tip is smooth with no rib so that discomfort of the use of the guide member is minimised, should a rib protrude from the contact surface, the edge of the rib can exert an uncomfortable pressure on the radial side of the forearm of the user.

Figure 2:
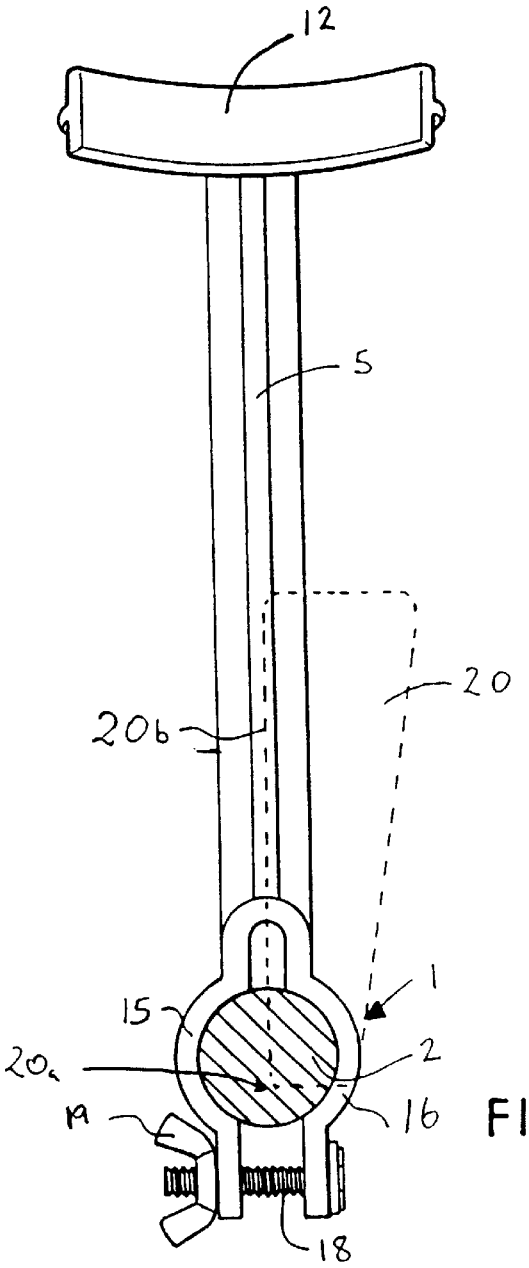
FIG. 2 is a cross sectional drawing of the guide member attached to the shaft of a golf club showing particularly the alignment between the stem of the guide and the club head.
Figure 3:
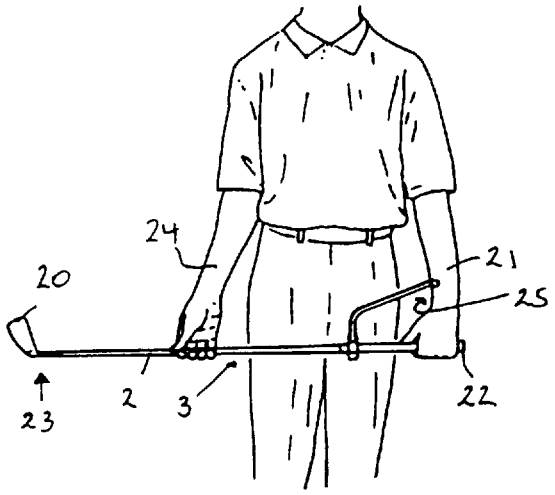
FIG. 3 shows the manner in which the position of the guide member can be adjusted relative to the leading forearm and the club shaft.

The way in which the guide member is to be fitted to the golf club (3) is best seen in FIG. 2 and 3. The shaft of the golf club (2) is fitted through channel (17) of the clamp (1) of the guide member so that the free end of the guide member extends away from the shaft of the golf club in the same axial direction as the upper most end (22) of the golf club. The wings of the clamp will normally need to be spread apart to fit over the shaft. The stem (5) of the guide member is radially aligned with the leading edge of (20*a*) of the head (20) of the golf club as can best be seen in FIG. 2. It can be seen that the leading edge is at the base of the striking face (20*b*). The axial alignment of the guide member is achieved as best seen in FIG. 3. The golf club is held generally horizontally, the leading arm (21) is held downwards onto the uppermost end (22) of the golf club so that the leading arm extends at approximately right angles from the shaft of the golf club. The head end (23) of the golf club is supported by the lagging arm (24). The tip is moved axially along the shaft until contact is made with the radial portion (25) of the leading forearm of the player, and then the guide member is attached to the shaft of the golf club by tightening the wing nut to clamp the guide member onto the shaft to fix it into place.

Figure 5:
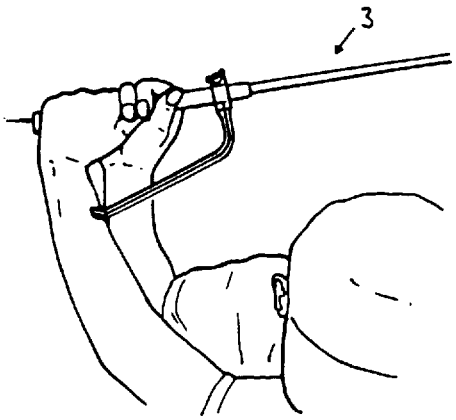
FIG. 5 shows that the guide member is in contact with the leading forearm at the top of the backswing before the downswing is started.

The use of the guide can be represented by the sequence of positions shown in FIGS. 4 to 9. In use the golf club is held properly in place; the address positioned is assumed (not shown) with the feet spaced apart and the golf club positioned downwardly. The correct position of the club can be verified by looking to see that the stem of the guide is vertical. It is difficult to see simply by looking at the head of the golf club. The backswing is started with the golf club brought upwardly (see FIG. 4), and the weight of the player is transferred to the lagging side, the position of the guide is to be maintained vertically above the shaft of the club. The back swing is continued until the top of the backswing is reached with the tip contacting the radial side of the forearm of the player, as can be seen in FIG. 5. If an incorrect position is assumed, the tip will sit skewed on the radial side of the leading forearm or one of the arms of the tip will dig into the forearm of the player.

Figure 6:
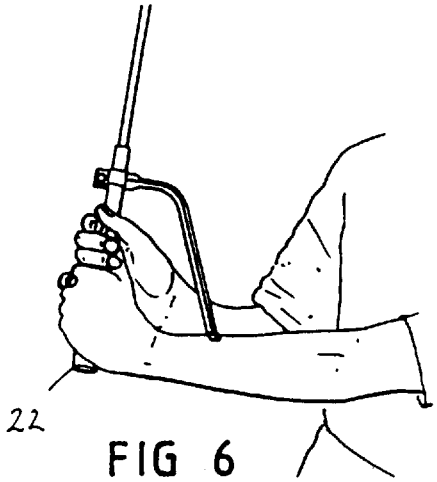
FIG. 6 shows the guide is still in contact with the leading forearm some way into the downswing.
Figure 4:
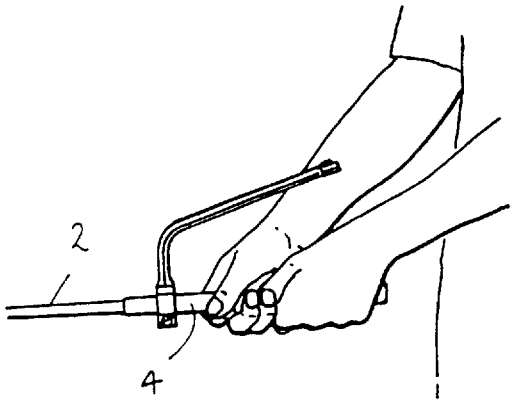
FIG. 4 shows the position of the guide member relative to arm when the back swing is started.
Figure 7:
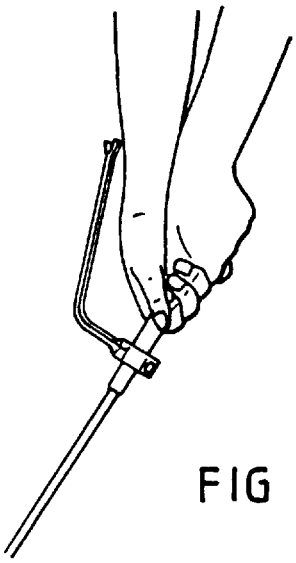
FIG. 7 shows the guide is out of contact further into the downswing.
Figure 8:
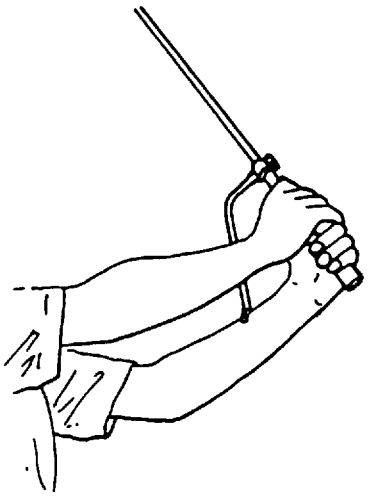
FIG. 8 shows the guide member beginning to make contact with the leading forearm once it approaches the end of the follow through, FIG. 9 shows the finishing of the follow through with the guide member in full contact with the leading forearm.
Figure 9:
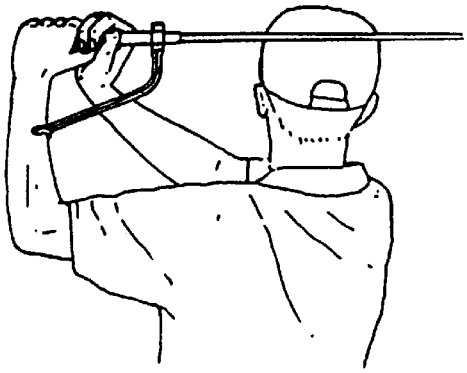

The downswing can be commenced, and the shaft of the club is brought downwardly, whilst maintaining contact between the tip of the guide and the radial side of the forearm of the player, until approximately the position shown in FIG. 6 is shown, which represents approximately a three quarters backswing position. Contact with the tip is broken and the downswing is continued as represented in FIG. 7. The ball is struck and the follow through is commenced; all without any contact being made between the arms of the player and the guide. Contact is again made at the upper part of the follow through once the arms are brought upwardly commencing at what might be termed the three quarters follow through position, approximately as shown in FIG. 8. The follow through is then continued until the club is brought behind the player as can be seen in FIG. 9.

It will be found that the three quarter backswing position and the three quarters follow through position will be somewhat different for each individual but can be found simply by practicing with the guide.

The position in which the golf club is held is easily checked, in the address position, in that the position of the stem of the guide member is far more apparent than the head of a golf club because it is directly in the line of sight of the player relative to the shaft. The position of the guide member can be checked by the player by eye to align vertically with the shaft of the golf club to ensure that the club is held correctly.

When the club is raised to the top of the backswing feedback is provided to ensure that once the leading arm of the player is straight, the angle at which the club is held is correct, and that it is therefore in the plane of the arc of the swing. Maintaining contact between the leading arm and the tip of the guide during the initial part of the downswing to approximately the three quarters backswing position encourages a fuller arc to be formed, and accordingly tends to provide for a fuller swing with the potential for greater power to be imparted on the ball to be struck.

The contact is then broken until approximately the three quarter follow through position is attained, and during that portion of the arc of the swing there is no tactile feedback of the quality of the swing, it is not until such contact is again achieved that tactile feedback regarding the result of the swing is again achieved. If the swing has followed the desired arc, then the tip will make a square on contact with the radial side of the forearm and will sit comfortably.

In order that the lower part of the swing is practiced, it is possible to practice a swing with reduced power, where the golf club is swung between the backswing three quarters position and the follow-through three quarters position. This can be an initial exercise in practicing an accurate swing.

Figure 10:
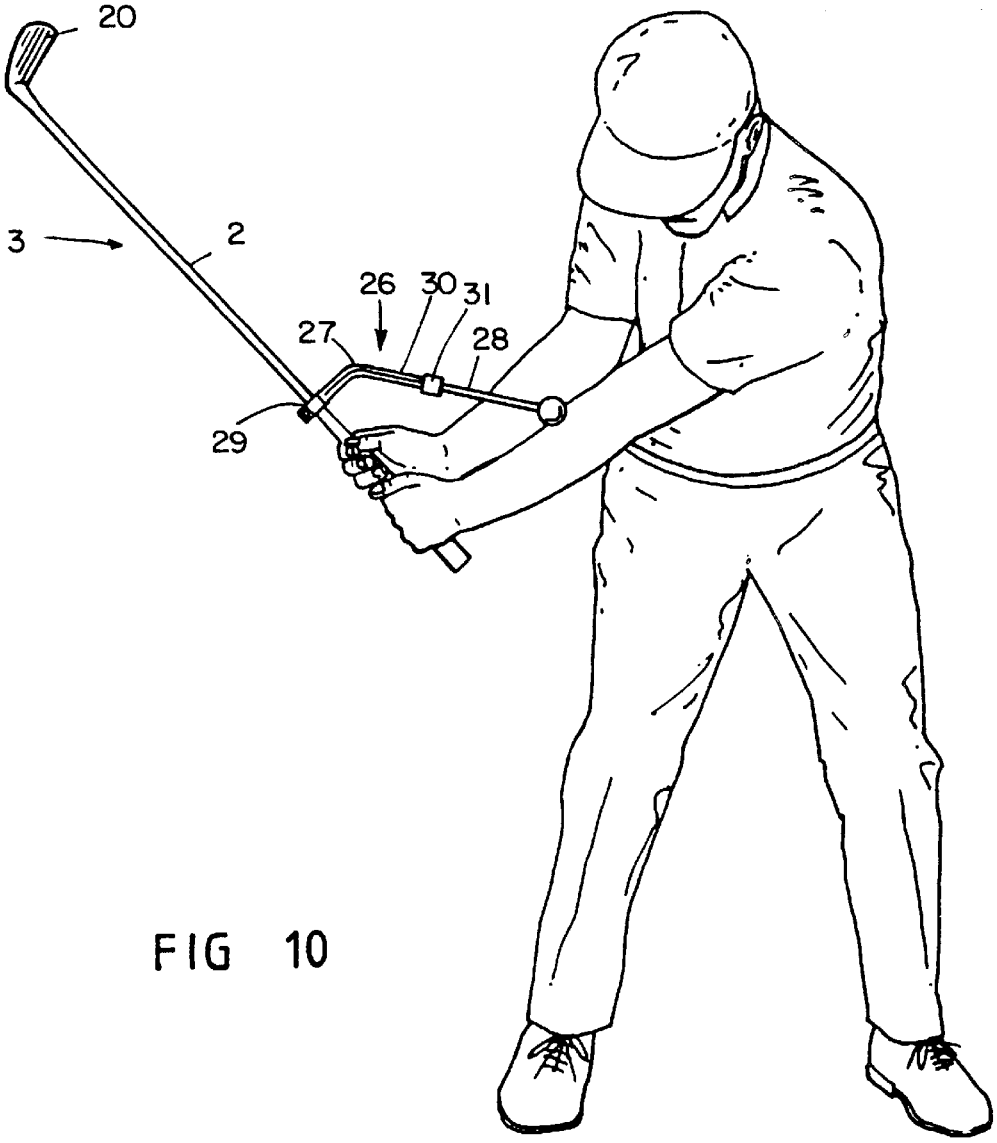
FIG. 10 shows a second embodiment of the invention.

A second embodiment of the invention is shown in FIG. 10 held by a player at a lower part of the downswing.

In this second embodiment, the guide (26) is constructed of a tubular aluminium and the guide is comprised of two separate parts (27 and 28). A first part (27) includes the attachment means which takes the form of a clamp (28), and a first part (28) of the stem (30) of the guide. A second part comprises a telescoping portion of the stem and the tip. The telescoping portion can vary the length of the stem. This feature is particularly useful where the guide is to be permanently attached to the shaft of a golf club, whereby to permit adjustment of the position of the tip relative to the shaft. A locking ring (31) is provided to lock the relative position of the telescoping portion to the first part.

In the second embodiment the tip is in the form of a ball to make contact with the radial side of the forearm of the user. The operation of this second embodiment is substantially identical to the first embodiment.

We claim:

1. A method of training golf swing including the steps of:

(i) adjusting the position of a guide relative to a golf club so that the guide projects vertically when the club is held in an address position, a tip at a free end of the guide bears against the radius side of a leading forearm when the club is held in a back swing position, and the tip bears against the radius side of the leading forearm when the club is held in a follow through position;

(ii) repeatedly swinging the golf club between back swing and follow through positions;

(iii) correcting golf swing to ensure that at the back swing position the tip bears against the radius side of the leading forearm; and, (iv) correcting golf swing to ensure that at the follow through position the tip bears against the radius side of the leading forearm.

2. A method as in claim 1 including the step of:

(v) correcting golf swing to ensure that except at the back swing and the follow through positions the guide does not contact the body of the golfer.

3. A method as in claim 2 including the step of:

(vi) correcting golf swing to ensure that the tip contacts the leading forearm at the same location of the leading forearm.

4. A method as in claim 3 wherein the location of the leading forearm is central between the outside and inside of the forearm.

5. A method as in claim 1 including the step of:

(vii) correcting golf swing to ensure that when the club is swung from the back swing position to the address position the tip remains in contact with the leading forearm until a three quarter back swing position.

6. A method as in claim 1 wherein the guide is adjusted so that the tip bears against the radial side of the leading forearm when the club is held in the back swing position and the wrists are radially deviated towards the radius side of the forearms.

7. A method as in claim 1 wherein the guide is adjusted by releasing clamping means, sliding attachment means up or down a shaft of the club and securing the clamping means to fasten the guide in position.

8. A method as in claim 1 wherein the guide is adjusted by releasing locking ring means, increasing or decreasing a length of a stem of the guide formed in two cooperating parts by telescoping one part into the other, and securing the locking ring means to fasten the stem at a length at which the guide is in position.

9. A method of training golf swing including the steps of:

(i) adjusting the position of a guide relative to a golf club so that the guide projects vertically when the club is held in the address position, an arcuate tip at a free end of the guide bears against and contours about the radius side of a leading forearm when the club is held in the back swing position, and the tip bears against and contours about the radius side of a leading forearm when the club is held in the follow through position;

(ii) repeatedly swinging the golf club between back swing and follow through positions;

(iii) correcting golf swing to ensure that at the back swing position the tip bears against and contours about the radius side of the leading forearm;

(iv) correcting golf swing to ensure that at the follow through position the tip bears against and contours about the radius side of the leading forearm;

(v) correcting golf swing to ensure that except at the back swing and the follow through positions the guide does not contact the body of the golfer; and, (vi) correcting golf swing to ensure that the tip contacts the leading forearm at the same location of the leading forearm.

10. A method as in claim 9 including the step of:

(vii) correcting golf swing to ensure that when the club is swung from the back swing position to the address position the tip remains in contact with the leading forearm until a three quarter back swing position.

11. A method as in claim 9 wherein the guide is adjusted so that the tip bears against the radial side of the leading forearm when the club is held in the back swing position and the wrists are radially deviated towards the radius side of the forearms.

* * * * *

UNITED STATES PATENT AND TRADEMARK OFFICE

CERTIFICATE OF CORRECTION

PATENT NO. : 5,846,143

DATED : DECEMBER 8, 1998

INVENTOR(S) : BROCK ET AL.

It is certified that error appears in the above-identified patent and that said Letters Patent is hereby corrected as shown below:

Col. 3, line 55: "collect" should read —correct—

Col. 7, line 55: "(28)" should read —(29)—

Col. 7, line 56: delete "(28)" after the first occurrence of the word "part"

Col. 7, line 56: insert —(28)— after the second occurrence of the word "part"

Signed and Sealed this

Twenty-sixth Day of December, 2000

*Attest:*

*Attesting Officer*

Q. TODD DICKINSON

*Director of Patents and Trademarks*